US011658438B1

(12) United States Patent
Lee et al.

(10) Patent No.: US 11,658,438 B1
(45) Date of Patent: May 23, 2023

(54) ELECTRICAL CONNECTOR WITH INTEGRATED SEALING MECHANISM

(71) Applicant: SHPP Global Technologies B.V., Bergen op Zoom (NL)

(72) Inventors: Shawn Lee, Pittsfield, MA (US); David Wimberly, Pittsfield, MA (US); John McKenzie, Pittsfield, MA (US); Trevor Jackson, Pittsfield, MA (US)

(73) Assignee: SHPP GLOBAL TECHNOLOGIES B.V., Bergen op Zoom (NL)

( * ) Notice: Subject to any disclaimer, the term of this patent is extended or adjusted under 35 U.S.C. 154(b) by 31 days.

(21) Appl. No.: 17/555,075

(22) Filed: Dec. 17, 2021

(51) Int. Cl.

| | |
|---|---|
| ***H01R 13/52*** | (2006.01) |
| ***H01R 43/00*** | (2006.01) |
| ***H01R 13/70*** | (2006.01) |
| *H01R 31/06* | (2006.01) |
| *H01R 13/447* | (2006.01) |
| *H01R 13/502* | (2006.01) |

(52) U.S. Cl.
CPC ..... *H01R 13/5213* (2013.01); *H01R 13/701* (2013.01); *H01R 43/005* (2013.01); *H01R 13/447* (2013.01); *H01R 13/502* (2013.01); *H01R 31/06* (2013.01)

(58) Field of Classification Search
CPC ..... H01R 13/5213; H01R 13/701; H01R 43/005; H01R 13/447; H01R 13/502; H01R 31/06
See application file for complete search history.

(56) References Cited

U.S. PATENT DOCUMENTS

| | | | | | |
|---|---|---|---|---|---|
| 3,599,167 | A * | 8/1971 | Adrian | H01R 13/633 | 439/348 |
| 4,643,505 | A * | 2/1987 | House | H01R 13/6392 | 439/267 |
| 4,787,706 | A * | 11/1988 | Cannon, Jr. | G02B 6/3888 | 385/59 |
| 5,108,297 | A * | 4/1992 | Hoffman | H01R 13/625 | 439/304 |
| 5,259,052 | A * | 11/1993 | Briggs | G02B 6/3878 | 385/78 |
| 11,316,299 | B2 * | 4/2022 | Klinedinst | H01R 13/447 | |
| 2021/0066848 | A1 * | 3/2021 | Klinedinst | H01R 13/502 | |

* cited by examiner

*Primary Examiner* — Tho D Ta
(74) *Attorney, Agent, or Firm* — Norton Rose Fulbright US LLP

(57) ABSTRACT

An electrical connector can include a receptacle disposed in a housing. The housing can include a second end and an openable first end having at least two housing portions that are movable relative to each other between: an open position in which the receptacle is accessible by a plug through the housing portions; and a closed position in which the receptacle is not accessible by the plug through the housing portions. At least one of the housing portions can be biased toward the open position. The electrical connector can further include a grip coupled to the housing and movable relative to the housing between a first position that permits movement of the housing portions to the open position; and a second position in which the grip overlies the at least one biased-open housing portion such that the grip prevents movement of the housing portions to the open position.

15 Claims, 8 Drawing Sheets

ELECTRICAL CONNECTOR WITH INTEGRATED SEALING MECHANISM

FIELD OF INVENTION

The present disclosure relates generally to electric power devices, and, specifically, to extension cords and electrical outlets.

BACKGROUND

Extension cords can provide power from a power source to an electronic device at a location a distance away from the power source. In some situations, extension cords are used outdoors. Additionally, electrical outlets and outlet boxes may be located in an outdoor environment. Weather, such as rain, snow, or other precipitation, may cause a ground fault due to moisture at the point of electrical connection. Should the path to ground pass through a person, the person may experience burns or other injuries. Covers for extension cords are available, but such covers are prone to wear out over time and require multiple steps and/or fasteners to form a secure seal around the extension cord or do not seal well such that moisture is not excluded from the cover when the extension cord is electrically connected to another cord or power source.

SUMMARY

The present disclosure describes electrical connectors, such as extension cords and electrical outlets, and operations thereof. An electrical connector may be with integrated with one or more components to ensure the connector forms in one step a complete seal to exclude moisture from the connector. The electrical connector may also be with integrated with safety measures to provide for safe operation of the electrical connector.

The electrical connector may include a receptacle configured to receive a plug and a housing. The receptacle may be disposed within the housing, and the housing may be configured to move with respect to the receptacle between an open position in which the housing is configured to enable access to the receptacle for receipt of a plug and a closed position in which the receptacle is not accessible by a plug. At least a portion of the housing may be biased toward the open position. Such biasing may be accomplished using a frame defined by a first resilient polymer. The frame may be coupled to a second resilient polymer that has a stiffness that is less than a stiffness of the first resilient polymer and that, when the housing is in the closed position, enables sealing of the housing. A transition of the housing from the open position to the closed position may be facilitated by a grip coupled to the housing and moveable relative to the housing between a first position configured to enable movement of the housing to the open position and a second position configured to enable movement of the housing to the closed position. When in the second position, the grip may overlie a portion of the housing that is biased toward to the open position to prevent movement of the housing to the open position.

Thus, the present disclosure describes one or more electrical connectors with integrated or unitary components to ensure the connector forms a seal around the receptacle. For example, the multi-polymeric housing and the grip may be configured to operate together to form an enclosed chamber that protects the receptacle and/or the plug from precipitation, such as rain or snow, or other moisture.

Some of the present electrical connectors include a receptacle, a housing within which the receptacle is disposed, and a grip coupled to the housing. In some embodiments, the housing includes a second end and an openable first end having at least two housing portions that are movable relative to each other between an open position in which the receptacle is accessible by a plug through the housing portions and a closed position in which the receptacle is not accessible by the plug through the housing portions. In some embodiments, at least one of the housing portions is biased toward the open position. In some embodiments, the grip is movable relative to the housing between a first position in which the grip permits movement of the housing portions to the open position and a second position in which the grip overlies the at least one biased-open housing portion such that the grip prevents movement of the housing portions to the open position.

In some embodiments, the housing portions are not hinged. Additionally, or alternatively, in some embodiments, the at least one biased-open housing portion comprises a first resilient polymer. Optionally, the first resilient polymer comprises polyetherimide. In some such embodiments, the at least one biased-open housing portion includes a frame that is defined by the first resilient polymer and a second resilient polymer. In some embodiments, the second resilient polymer is coupled to the frame such that, when the housing portions are in the closed position, the second resilient polymer contacts at least one other of the housing portions. In some embodiments, the second resilient polymer has a stiffness that is 50% or less of a stiffness of the first resilient polymer. In some embodiments, the second resilient polymer has a hardness of between 30 and 90 Shore A. Optionally, the second resilient polymer comprises silicone.

In some embodiments, at least one of the housing portions defines a rib that is configured to be received by a groove of another one of the housing portions when the housing portions are in the closed position. In some such embodiments, the outer surface at least one of the rib and the groove is defined by the second resilient polymer. In some embodiments, when the housing portions are in the closed position, the housing portions define a passageway configured to receive a power cord, and a minimum transverse dimension of the passageway decreases along the passageway. In some such embodiments, at least a portion of the passageway is defined by the second resilient polymer.

In some embodiments, the electrical connector further includes a detent configured to maintain the grip in the second position. Additionally, or alternatively, in some embodiments, the grip defines a channel, the housing defines a ridge that is received by the channel, and the ridge and the channel are configured to guide the grip between the first position and the second position. In some such embodiments, a portion of the ridge that contacts the channel is defined by the frame of the at least one biased-open housing portion.

In some embodiments, the electrical connector further includes a switch that is disposed within the housing and configured to be coupled to a power source. In some such embodiments, when the grip is in the first position, the switch prevents electrical communication between the receptacle and the power source. In some such embodiments, when the grip is in the second position, the switch prevents electrical communication between the receptacle and the power source.

Some of the present methods of making an electrical connection include inserting a plug of a power cord through at least two housing portions of a housing while the housing portions are in an open position to which at least one of the housing portions is biased and into a receptacle that is disposed within the housing and moving the housing portions relative to one another to a closed position at least by moving a grip that is coupled to the housing relative to the housing from a first position to a second position in which the grip overlies more of the at least one biased-open housing portion than when the grip is in the first position. In some embodiments, when the housing portions are in the closed position, the housing portions contact a portion of the power cord that extends to the plug.

In some methods, the housing portions are not hinged. Additionally, or alternatively, in some methods, the at least one biased-open housing portion comprises a first resilient polymer. Optionally, the first resilient polymer comprises polyetherimide. In some such methods, the at least one biased-open housing portion includes a frame that is defined by the first resilient polymer and a second resilient polymer. In some methods, the second resilient polymer is coupled to the frame such that, when the housing portions are in the closed position, the second resilient polymer contacts at least one other of the housing portions. In some methods, the second resilient polymer has a stiffness that is 50% or less of a stiffness of the first resilient polymer. In some methods, the second resilient polymer has hardness of between 30 and 90 Shore A. Optionally, the second resilient polymer comprises silicone.

In some methods, at least one of the housing portions defines a rib that is received by a groove of another one of the housing portions when the housing portions are in the closed position. In some such methods, the outer surface at least one of the rib and the groove is defined by the second resilient polymer. In some methods, when the housing portions are in the closed position, the housing portions define a passageway that receives the portion of the power cord contacted by the housing portions, and a minimum transverse dimension of the passageway decreases along the passageway. In some such methods, at least a portion of the passageway is defined by the second resilient polymer.

In some methods, the electrical connector further includes a detent configured to maintain the grip in the second position. Additionally, or alternatively, in some methods, the grip defines a channel, and the housing defines a ridge that is received by the channel such that the ridge and the channel guide the grip between the first position and the second position. In some such methods, a portion of the ridge that contacts the channel is defined by the frame of the at least one biased-open housing portion.

In some methods, the electrical connector further includes a switch that is disposed within the housing and configured to be coupled to a power source. In some such embodiments, when the grip is in the first position, the switch prevents electrical communication between the receptacle and the power source. In some such embodiments, moving the grip to the second position actuates the switch to permit electrical communication between the receptacle and the power source.

As used herein, various terminology is for the purpose of describing particular embodiments only and is not intended to be limiting of embodiments. For example, as used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). The term "coupled" is defined as connected, although not necessarily directly, and not necessarily mechanically; two items that are "coupled" may be unitary with each other. The terms "a" and "an" are defined as one or more unless this disclosure explicitly requires otherwise.

The term "about" as used herein can allow for a degree of variability in a value or range, for example, within 10%, within 5%, or within 1% of a stated value or of a stated limit of a range, and includes the exact stated value or range. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, or 5 percent; and the term "approximately" may be substituted with "within 10 percent of" what is specified. The statement "substantially X to Y" has the same meaning as "substantially X to substantially Y," unless indicated otherwise. Likewise, the statement "substantially X, Y, or substantially Z" has the same meaning as "substantially X, substantially Y, or substantially Z," unless indicated otherwise. The phrase "and/or" means and or. To illustrate, A, B, and/or C includes: A alone, B alone, C alone, a combination of A and B, a combination of A and C, a combination of B and C, or a combination of A, B, and C. In other words, "and/or" operates as an inclusive or. Similarly, the phrase "A, B, C, or a combination thereof" or "A, B, C, or any combination thereof" includes: A alone, B alone, C alone, a combination of A and B, a combination of A and C, a combination of B and C, or a combination of A, B, and C.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range.

The terms "comprise" and any form thereof such as "comprises" and "comprising," "have" and any form thereof such as "has" and "having," "include" and any form thereof such as "includes" and "including," and "contain" and any form thereof such as "contains" and "containing," are open-ended linking verbs. As a result, an apparatus that "comprises," "has," "includes," or "contains" one or more elements possesses or contains those one or more elements, but is not limited to possessing or containing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb. Additionally, the term "wherein" may be used interchangeably with "where".

Further, a device or system that is configured in a certain way is configured in at least that way, but it can also be configured in other ways than those specifically described. The feature or features of one embodiment may be applied to other embodiments, even though not described or illustrated, unless expressly prohibited by this disclosure or the nature of the embodiments.

Some details associated with the embodiments are described above and others are described below. Other embodiments, advantages, and features of the present disclosure will become apparent after review of the entire application, including the following sections: Brief Description of the Drawings, Detailed Description, and the Claims.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. Views in the figures are drawn to scale, unless otherwise noted, meaning the sizes of the depicted elements are accurate relative to each other for at least the embodiment in the view.

DETAILED DESCRIPTION

Figure 1A:
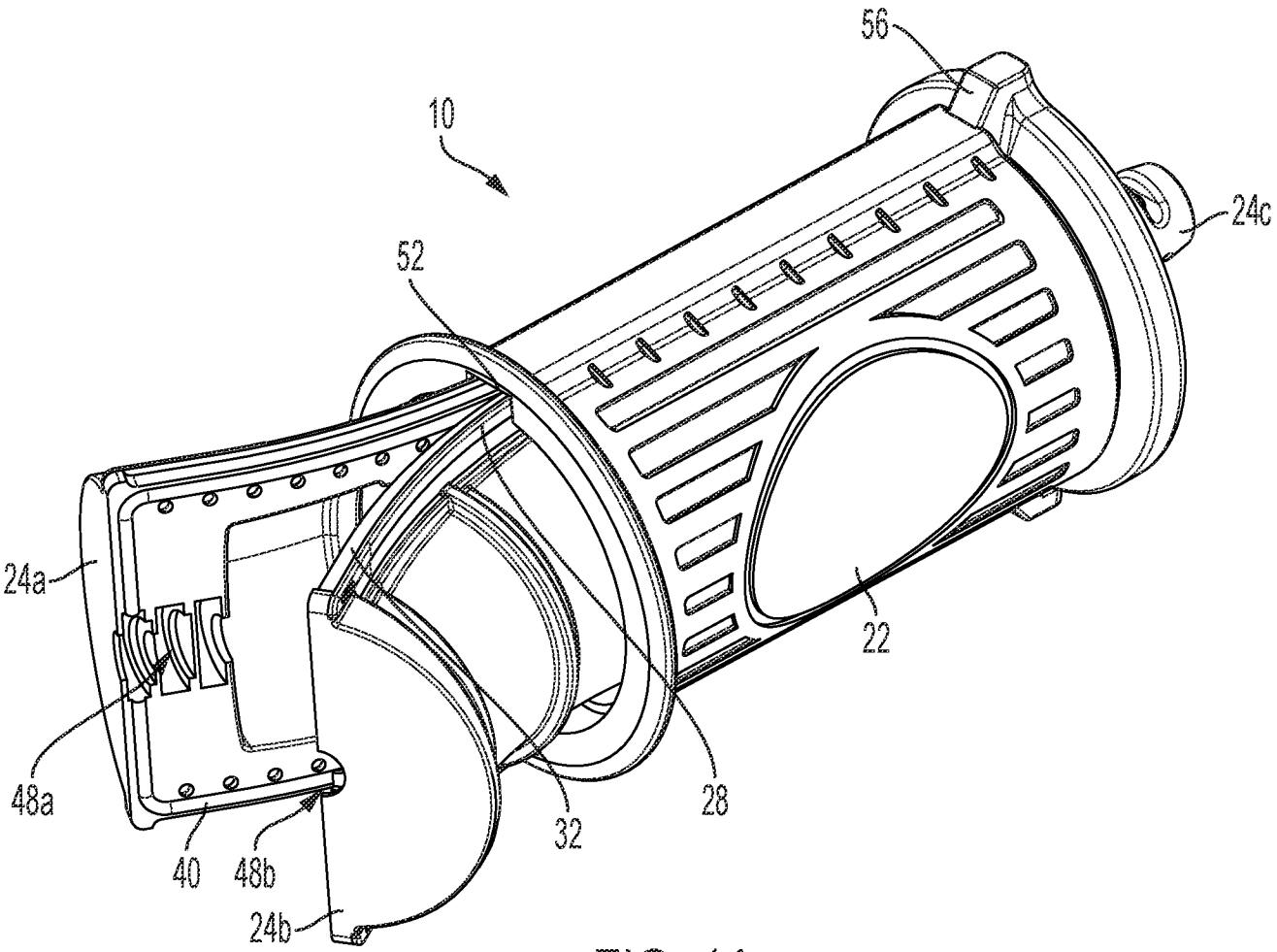
FIG. 1A is a perspective view of one of the present electrical connectors having at least one of at least two housing portions biased toward an open position and a grip movable relative to the housing that permits movement of the biased-open housing portion to the open position.

Referring to FIGS. 1A-1H, shown is an embodiment 10 of the present electrical connectors for sealing off elements contained therein from moisture. Electrical connector 10 is configured to be coupled to a power source (e.g., a generator, a transformer, an inverter, a battery, a solar panel, etc.). In some embodiments, electrical connector 10 further includes a power supply cord (not illustrated) including one or more conductors coupled to electrical connector 10. For example, the power supply cord may couple electrical connector 10 to the power source.

Electrical connector 10 can include a receptacle 14, a housing 24 within which the receptacle 14 is disposed, and a grip 22 coupled to the housing 24. Housing 24 makes up a body/housing of electrical connector 10. In a particular embodiment, housing 24 is substantially cylindrical. In other embodiments, however, housing 24 can be substantially cuboidal or rectangular (e.g., an outlet box).

Figure 1C:
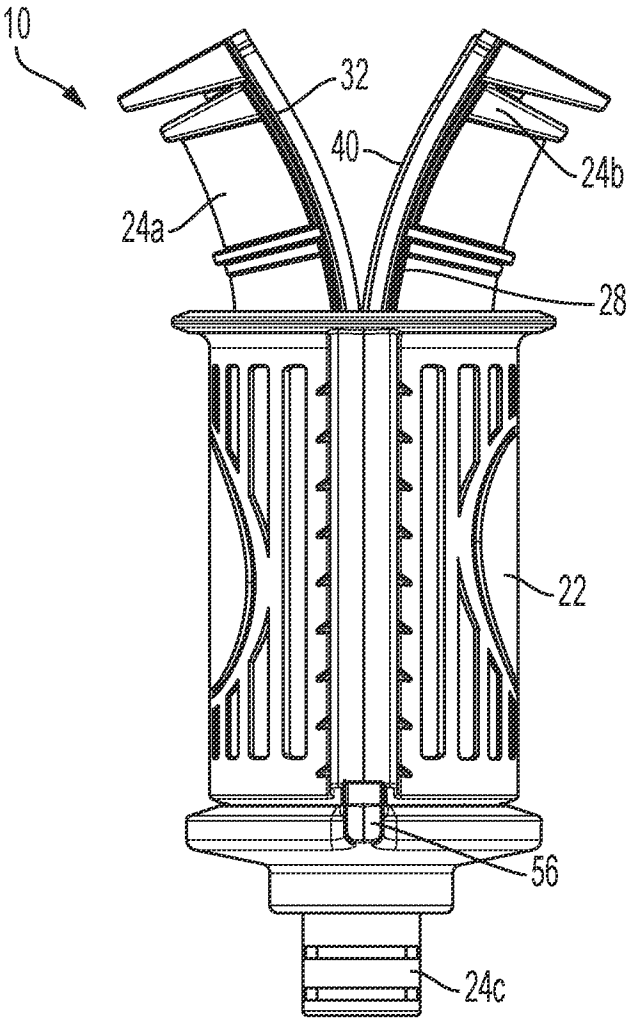
FIG. 1C is a bottom view of the electrical connector of FIG. 1A.
Figure 1B:
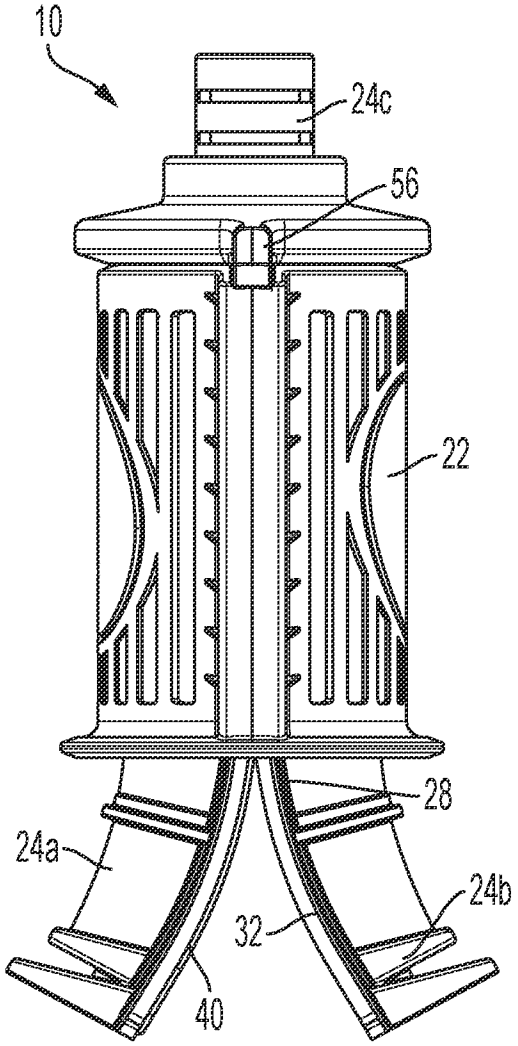
FIG. 1B is a top view of the electrical connector of FIG. 1A.
Figure 1D:
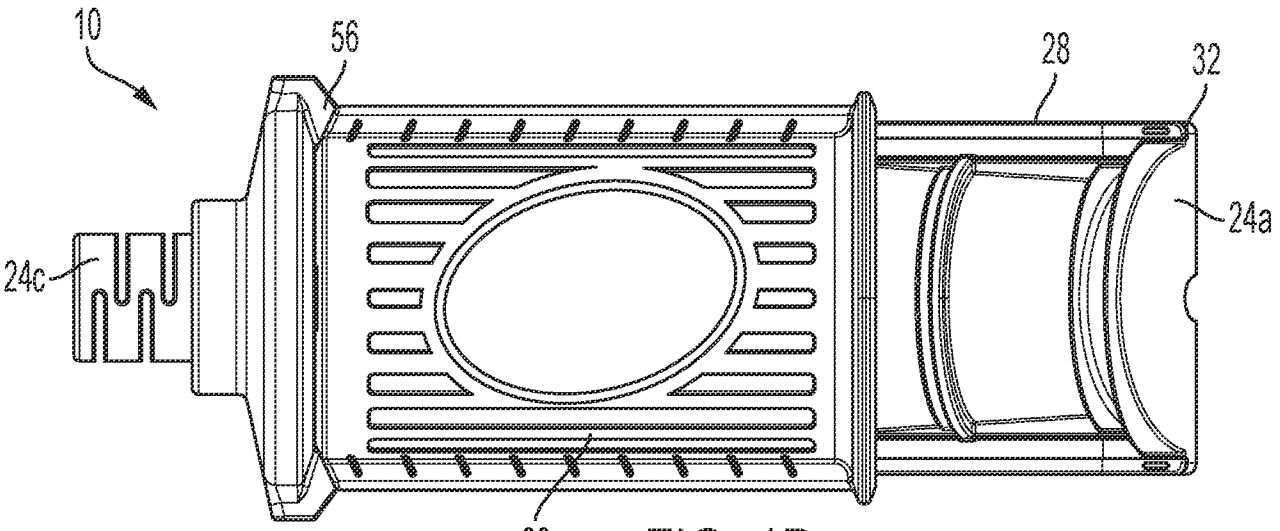
FIG. 1D is a right side view of the electrical connector of FIG. 1A.
Figure 1F:
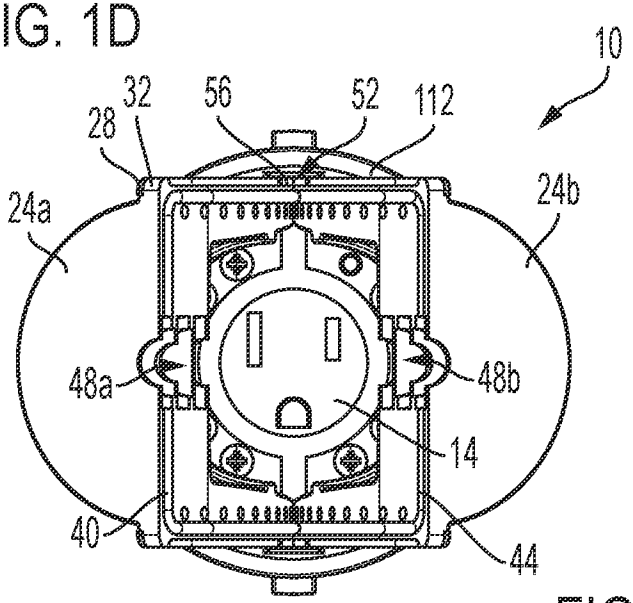
FIG. 1F is a front view of the electrical connector of FIG. 1A.
Figure 1E:
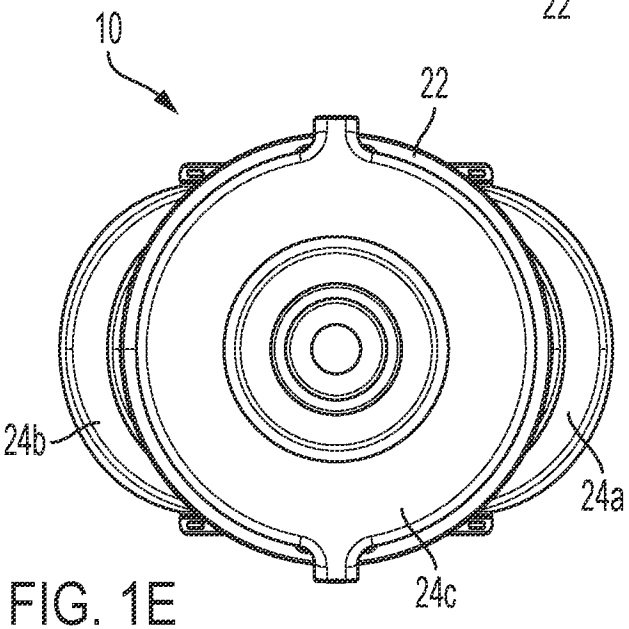
FIG. 1E is a back view of the electrical connector of FIG. 1A.
Figure 1G:
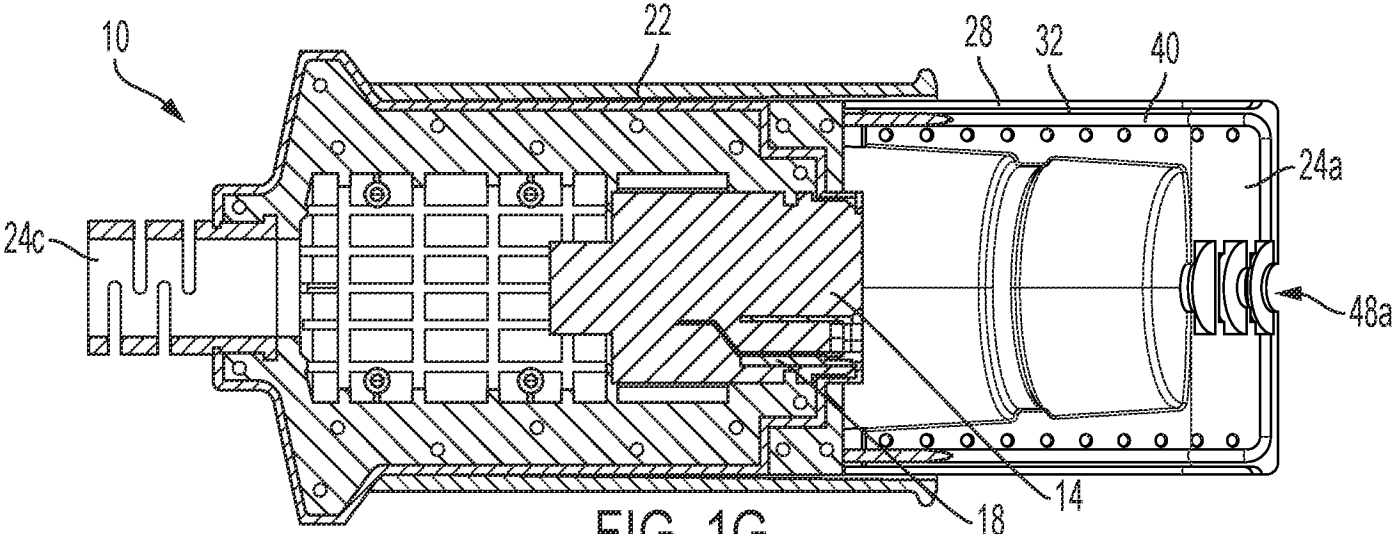
FIG. 1G is a cross-sectional top view of the electrical connector of FIG. 1A.
Figure 1H:
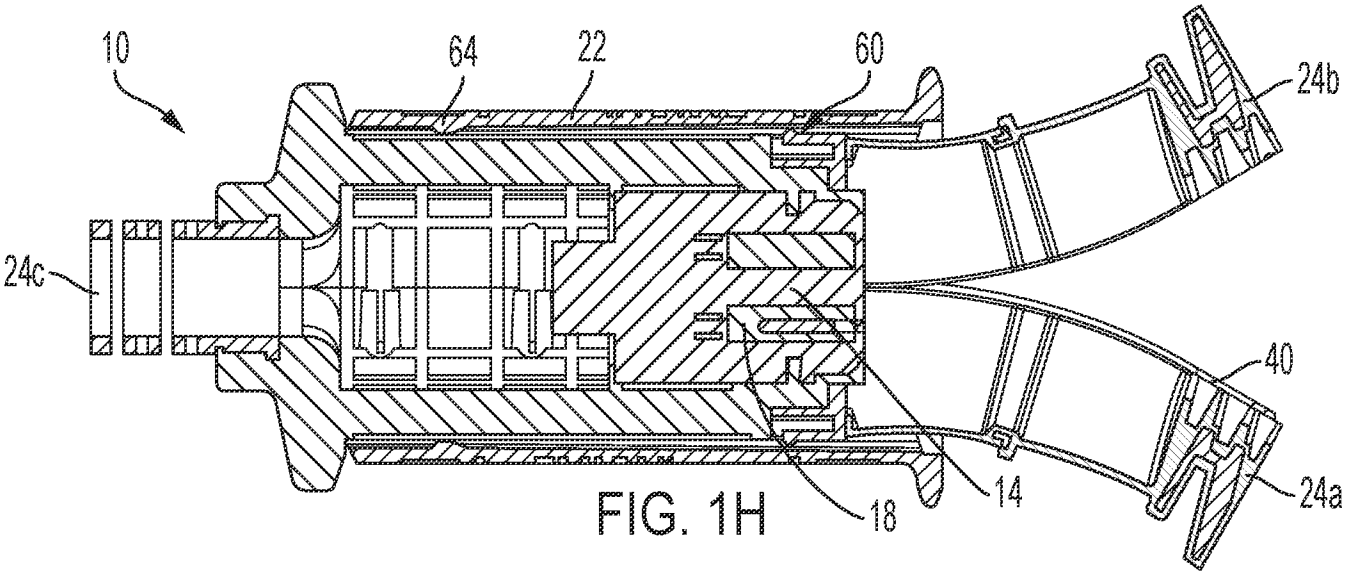
FIG. 1H is a cross-sectional side view of the electrical connector of FIG. 1A.
Figure 3A:
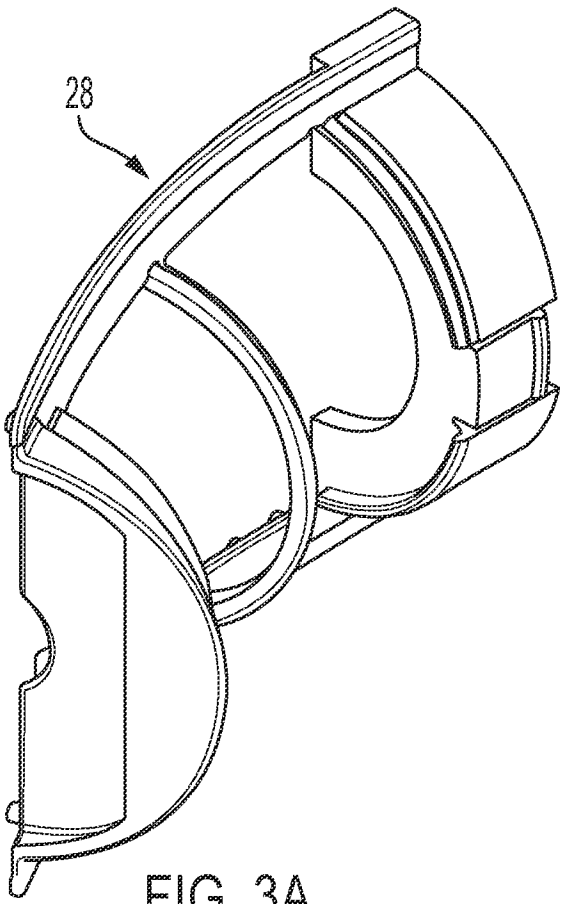
FIG. 3A is a perspective view of a frame defined by a first resilient polymer of the electrical connector of FIG. 1.
Figure 2:
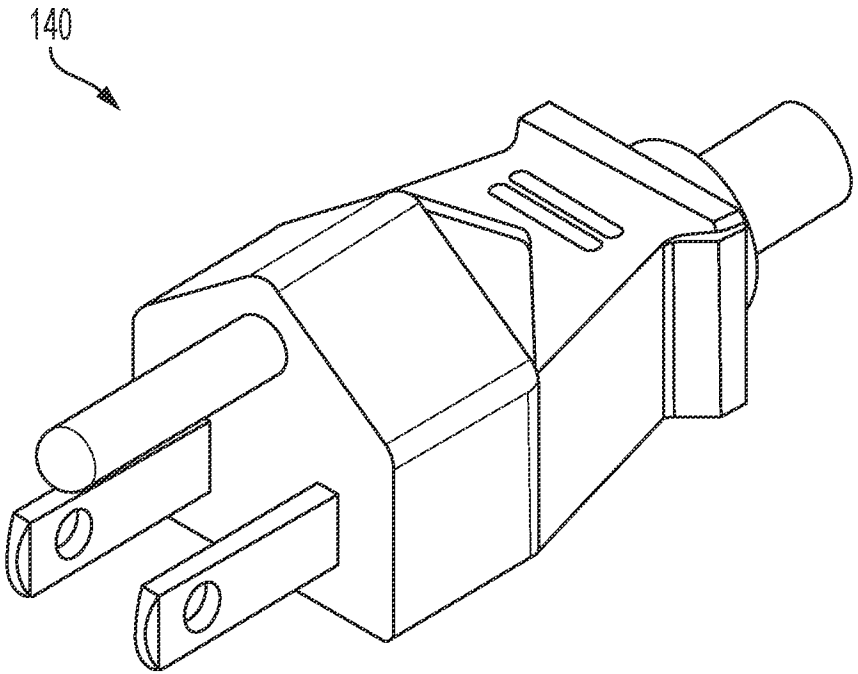
FIG. 2 is a perspective view of a plug of a power cord that is configured to be inserted through the housing portions of the electrical connector of FIG. 1.
Figure 3D:
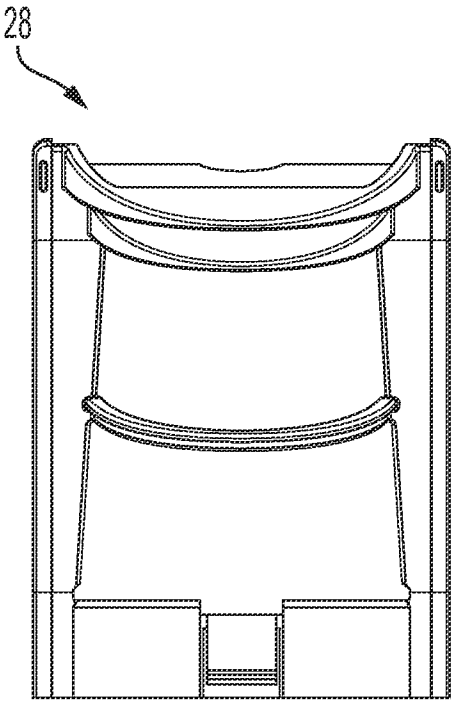
FIG. 3D is a bottom view of the frame of FIG. 3A.
Figure 3C:
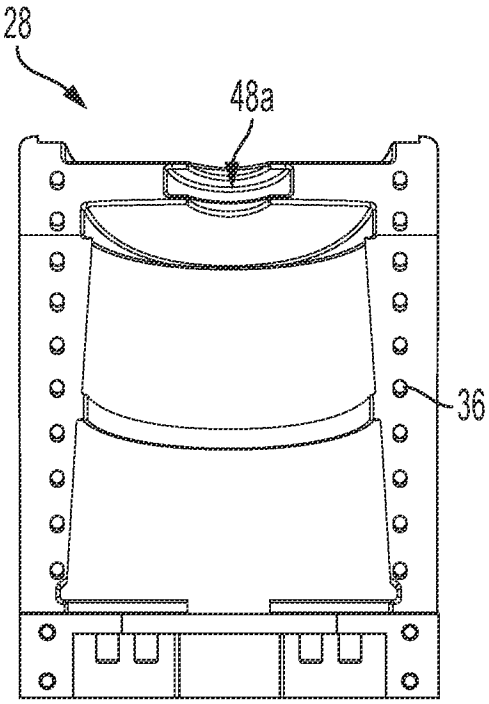
FIG. 3C is a top view of the frame of FIG. 3A.
Figure 3B:
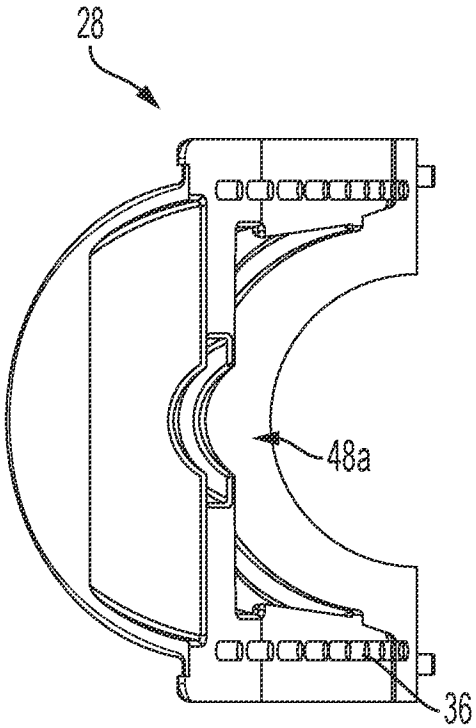
FIG. 3B is a front view of the frame of FIG. 3A.

Referring to FIG. 1F, receptacle 14 is configured to receive a plug 140 (e.g., as shown in FIG. 2). For example, receptacle 14 may include one or more conductive members 18 (e.g., as shown in FIG. 1H) configured to physically couple to one or more conductive members of plug 140. In some embodiments, receptacle 14 may be configured such that one or more portions of plug 140 are inserted into and received by receptacle 14 to electrically couple receptacle 14 and plug 140. In other embodiments, receptacle 14 and plug 140 may be configured such that one or more portions of receptacle 14 are inserted into and received by plug 140. Plug 140 may include a cord (e.g., an extension cord) coupled to plug 140 and configured to be coupled to an electronic device at a location away from electrical connector 10. Plug 140 and a portion of the cord may be inserted into housing 24 to couple plug 140 to receptacle 14. For example, one or more conductors (e.g., prongs or blades) of plug 140 may be coupled to one or more conductors of receptacle 14.

Referring to FIG. 1A, housing 24 can include an openable first end having at least two housing portions 24*a* and 24*b* and a second end 24*c*. Housing portions 24*a* and 24*b* may be flexible portions that are movable relative to each other (e.g., separable) between an open position and a closed position. FIG. 1A illustrates housing portions 24*a* and 24*b* in the open position. When in the open position, receptacle 14 may be accessible by plug 140 through housing portions 24*a* and 24*b*. When in the closed position, housing 24 defines an enclosed chamber, and access to receptacle 14 by the plug through housing portions 24*a* and 24*b* is inhibited. For example, housing 24 may not be open such that a plug may be inserted—e.g., insertion of a plug into receptacle 14 is prevented.

In some embodiments, movement of housing portions 24*a* and 24*b* relative to each other may be via separating, disengaging, pivoting, sliding, etc., housing portions 24*a* and 24*b* relative to each other. Alternatively, housing portions 24*a* and 24*b* may be hingedly coupled to one another, and movement of housing portions 24*a* and 24*b* relative to each other may be via one or more hinges. In certain embodiments, housing portions 24*a* and 24*b* are not hinged, and movement of housing portions 24*a* and 24*b* relative to each other is via separating housing portions 24*a* and 24*b* from each other.

Figure 4A:
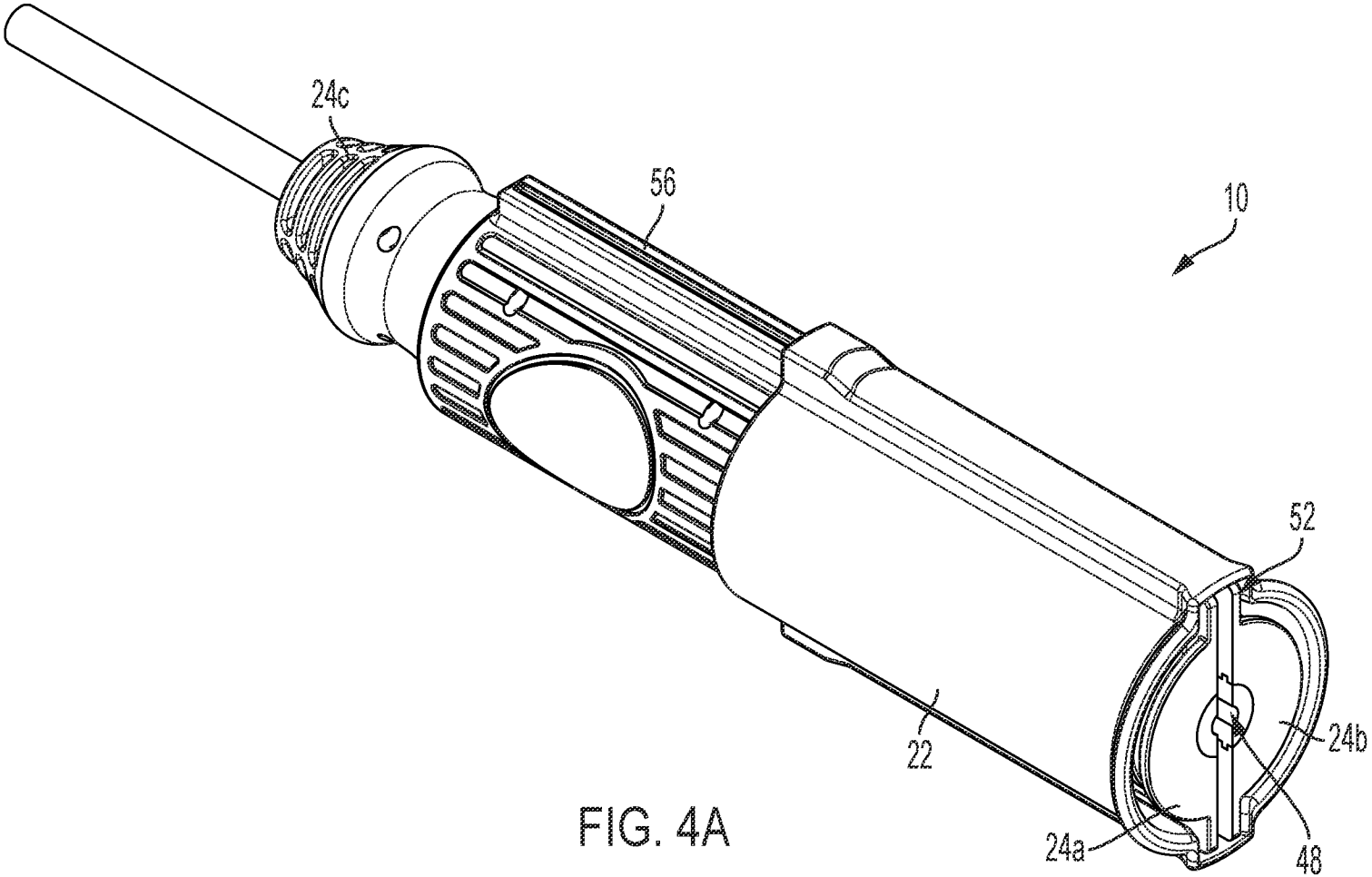
FIG. 4A is a perspective view of one of the present electrical connectors its housing portions in the closed position and a grip movable relative to the housing that prevents movement of the housing portions to the open position.

Housing portions 24*a* and 24*b* may be moved in multiple directions with respect to each other. For example, housing portions 24*a* and 24*b* may be movable in a first direction. The first direction may correspond to a transition from the open position (as illustrated in FIG. 1A and FIG. 1C) to the closed position (as illustrated in FIG. 4A). As another example, housing portions 24*a* and 24*b* may be movable in a second direction. The second direction is opposite to first direction and may correspond to a transition from the closed position to the open position.

In some embodiments, at least one of housing portions 24*a* and 24*b* is biased toward the open position. In some embodiments, both housing portions 24*a* and 24*b* are biased toward the open position. The biased-open housing portion(s) 24*a* and/or 24*b* may comprise one or more resilient polymers (e.g., 1, 2, 3, 4, 5, or more resilient polymers) configured to absorb energy when housing portion(s) 24*a* and/or 24*b* are deformed elastically (e.g., bent, stretched, compressed, etc.) from a resting state and to release the absorbed energy upon force unloading to return housing portion(s) 24*a* and/or 24*b* to the resting state. For example, biased-open housing portion(s) 24*a* and/or 24*b* may comprise one or more polymers configured to absorb energy when housing portion(s) 24*a* and/or 24*b* are bent from an open resting position to a closed deformed position and may release the absorbed energy when housing portion(s) 24*a* and/or 24*b* are released to return to the open resting position.

Biased-open housing portion(s) 24*a* and/or 24*b* may include a first resilient polymer 28. Examples of suitable first resilient polymer 28 may include, but are not limited to, polyetherimide, polyamide, polycarbonate, acrylonitrile butadiene styrene, nylon, polysulfone, polyphenylsulfone, polyphenylene sulfide, polyethersulfone, polyether ether ketone, polyaryletherketone, polyphenylene ether, poly vinyl chloride, polyethylene terephthalate, polybutylene terephthalate, and/or polyphthalamide. In certain embodiments, first resilient polymer 28 is polyetherimide. Referring to FIGS. 3A-3D, first resilient polymer 28 may be configured to provide structural rigidity to biased-open housing portion(s) 24*a* and/or 24*b*. For example, first resilient polymer 28 may define a frame of biased-open housing portion(s) 24*a* and/or 24*b*. First resilient polymer 28 may be configured to provide flexibility to biased-open housing portion(s) 24*a* and/or 24*b*. For example, first resilient polymer 28 may have a stiffness that is 50% or more of a stiffness of second resilient polymer 32, e.g., first resilient polymer 28 may have a stiffness that is more than or equal to any one of, or between any two of, 50%, 55%, 60%, 65%, 70%, 75%, 80%, 85%, 90%, 95%, or 100% of a stiffness of second resilient polymer 32. In some embodiments, the stiffness of first resilient polymer 28 facilitates the elastic deformation of housing portion(s) 24*a* and/or 24*b* from an open resting position to a closed deformed position. First resilient polymer 32 may also decrease the tendency of housing portion(s) 24*a* and/or 24*b* to deform permanently under the influence of persistent mechanical stresses applied by a user.

Biased-open housing portion(s) 24*a* and/or 24*b* may also include a second resilient polymer 32. Second resilient polymer 32 may be an elastomeric material with a durometer between 30 and 90 Shore A hardness e.g., second resilient polymer 32 may have a durometer that is equal to any one of, or between any two of, 30, 35, 40, 45, 50, 55, 60, 65, 70, 75, 80, 85, 90 Shore A hardness. Second resilient polymer 32 may have a minimum tensile property of 2 to 6 MPa, e.g., equal to any one of, or between any two of, 2, 3, 4, 5, or 6 MPa. In some embodiments, second resilient polymer 32 has a minimum tensile property of 4 MPa. Second resilient polymer 32 may have a minimum elongation of between 80 and 120%, e.g., equal to any one of, or between any two of, 80%, 85%, 90%, 95%, 100%, 105%, 110%, 115%, or 120%. In some embodiments, second resilient polymer 32 may have a minimum elongation of 100%. Second resilient polymer 32 may have a V-0 flame rating. Examples of suitable second resilient polymer 32 may include, but are not limited to, silicone, poly dimethyl siloxane, polyolefin elastomer, thermoplastic urethane, thermoplastic elastomer, plasticized polyvinyl chloride, and/or flexible polyphenylene ether. In certain embodiments, second resilient polymer 32 is silicone.

Referring to FIGS. 1A-1G, second resilient polymer 32 may be coupled to the frame defined by first resilient polymer 28. For example, second resilient polymer 32 may be overmolded onto first resilient polymer 28. First resilient polymer 28 may be configured to facilitate its overmolding with second resilient polymer 32. For example, in the embodiment shown in FIGS. 3A and 3B, first resilient polymer 28 includes a plurality of protrusions 36 to strengthen coupling between first resilient polymer 28 and second resilient polymer 32 when first resilient polymer 28 is overmolded with second resilient polymer 32.

The reduced stiffness and/or hardness of second resilient polymer 32 may facilitate sealing of housing 24. Second resilient polymer 32 may be configured to seal housing 24 to define an enclosed chamber when biased-open housing portion(s) 24*a* and/or 24*b* are in the closed position. For example, when housing portion(s) 24*a* and 24*b* are in the closed position, second resilient polymer 32 may contact at least one other of housing portion(s) 24*a* or 24*b* such that housing 24 is sealed to define an enclosed chamber. In some embodiments, both housing portion(s) 24*a* or 24*b* include second resilient polymer 32, and second resilient polymer 32 of housing portion 24*a* contacts second resilient polymer 32 of housing portion 24*b* to seal housing 24 when housing portion(s) 24*a* and 24*b* are in the closed position.

To further facilitate sealing of housing 24, in some embodiments, at least one of housing portion(s) 24*a* or 24*b* defines a structure that is configured to engage and/or interact with a corresponding structure of another one of housing portion(s) 24*a* or 24*b* when housing portion(s) 24*a* and 24*b* are in the closed position. In some such embodiments, the outer surface at least one of the structures is defined by second resilient polymer 32. In other such embodiments, the outer surface of both structures is defined by second resilient polymer 32. For example, in the embodiment shown in FIG. 1F, housing portion 24*a* defines a rib 40 that is configured to be received by a groove or channel 44 of housing portion 24*b* when housing portions 24*a* and 24*b* are in the closed position. Such a configuration can improve the seal of housing 18 to form an enclosed chamber. The outer surface at least one of rib 40 and groove 44 may be defined by second resilient polymer 32. Alternatively, the outer surface of both rib 40 and groove 44 may be defined by second resilient polymer 32.

In some embodiments, housing 24 may have grooves and/or channels configured to receive a power cord (not illustrated) coupled to plug 140 when housing 24 is in the closed position and to seal the cord and plug 140 from moisture. For example, housing 24 may define a passageway 48 configured to surround the cord after plug 140 has been coupled to receptacle 14 and housing portions 24*a* and 24*b* have been transitioned to the closed position. Each of housing portions 24*a* or 24*b* may include one or more grooves. When housing 24 is in the open position, as shown in FIG. 1A and FIG. 1F, passageway 48 may consist of two halves, 48*a* and 48*b*, each half defined by the one or more grooves of housing portions 24*a* or 24*b*. When housing 24 is transitioned from the open position to the closed position, housing portions 24*a* and 24*b* may come together such that halves 48*a* and 48*b* of passageway 48 defined by the one or more grooves of housing portions 24*a* or 24*b* align to form passageway 48. In this way, passageway 48 can accommodate and provide a route of egress for the portion of the power cord coupled to plug 140 that lies within housing 24 when plug 140 is inserted into and received by receptacle 140.

Passageway 48 may have a minimum transverse dimension that decreases along passageway 48. Alternatively, passageway 48 may have a minimum transverse dimension that increases or remains constant along passageway 48. A configuration in which the minimum transverse dimension varies can allow passageway 48 to accommodate multiple cord gauges. Additionally, at least a portion of the passageway may be defined by second resilient polymer 32, and the stiffness and/or hardness of second resilient polymer 32 may improve the seal of housing 24 around the power cord where it exits housing 24. For example, passageway 48 may also define one or more resilient barriers through with the power cord must pass when exiting housing 24, and the one or more resilient barriers may be defined by second resilient polymer 32. Inclusion of the one or more resilient barriers does not impair and may instead improve receipt of a power cord coupled to plug 140 when housing 24 is in the closed position and sealing of the cord and plug 140 from moisture by passageway 48.

In some embodiments, electrical connector 10 also includes a grip 22. Grip 22 may be coupled to housing 24 and may be movable relative to housing 24. For example, grip 22 may be configured to move relative to housing 24 in a first direction corresponding to a first position of grip 22 in which grip 22 permits movement of housing portions 24*a* and 24*b* to the open position. Grip 22 may also be configured to move relative to housing 24 in a second direction opposite the first direction to a second position of grip 22 in which grip 22 prevents movement of housing portions 24*a* and 24*b* to the open position. In this way, grip 22 may be configured to enable movement of housing portions 24*a* and 24*b* in a first direction corresponding to the transition from the open position to the closed position. Grip 22 may also be configured to prevent movement of housing portions 24*a* and 24*b* in a second direction corresponding to the transition from the closed position to the open position. In some embodiments, grip 22 may include a sleeve or slide, twist barrel, or lever, as illustrative, non-limiting examples. The outside of grip 22 may include a plurality of grooves to stiffen the grip such that it can withstand pressure applied by a user during operation but overall thickness of grip 22 is minimized.

When grip 22 is a sleeve, grip 22 can surround housing and can extend from, but is not necessarily disposed at, the first end of housing 24 to the second end of housing 24. Grip 22 may include a rigid flange on the end adjacent to the first end of housing 24 to ensure grip 22 does not crush housing portions 24*a* and 24*b* when housing 24 is in the closed position. Sliding of grip 22 can cause movement of housing portions 24*a* and 24*b* such that sliding of grip 22 in a first direction to a first position causes movement of grip 22 in a first direction and movement of housing portions 24*a* and 24*b* in a second direction corresponding to the transition of housing 24 from the closed position to the open position, and sliding of grip 22 in a second direction opposite the first direction to a second position causes movement of grip 22 in a second direction and movement of housing portions 24*a* and 24*b* in a first direction corresponding to the transition of housing 24 from the open position to the closed position. Movement of housing portions 24*a* and 24*b* to the closed position may comprise elastic deformation due to sliding of grip 22 in the second direction to force biased-open housing portion(s) 24*a* and/or 24*b* toward one another, while movement of biased-open housing portion(s) 24*a* and/or 24*b* to the open position may comprise recoil, or separation, of housing portion(s) 24*a* and/or 24*b* from one another when grip 22 is slid in the first direction.

Electrical connector 10 may include a structure defined by housing 24 to engage and/or interact with a corresponding structure defined by grip 22 to enable/cause movement of housing 24 responsive to movement of grip 22. For example, in the embodiment shown in FIG. 1A and FIG. 1F, grip 22 may define a channel 52, while housing 24 may define a ridge 56 that is received by channel 52. Ridge 56 of housing 24 and channel 52 of grip 22 may be configured to guide grip 22 between the first position, corresponding to the open position for housing 24, and the second position, corresponding to the closed position for housing 24. A portion of ridge 56 may contact channel 52, and the portion of ridge 56 in contact with channel 52 may be defined by first resilient polymer 28. For example, in the embodiment shown in FIG. 1A, the frame of biased-open housing portion(s) 24*a* and/or 24*b* defined by first resilient polymer 28 contacts channel 52 along the sides of channel 52. Contact between first resilient polymer 28 and channel 52 along the sides of channel 52 may facilitate smooth movement of grip 22 between the first and second positions. In addition to guiding movement of housing 24, grip 22 can shield receptacle 14 and plug 140 when housing 24 is in the closed position from user-contact, dirt, moisture, and/or the like, enhancing the safety benefits and/or promoting a strong connection through which current can flow through the plug.

Figure 4B:
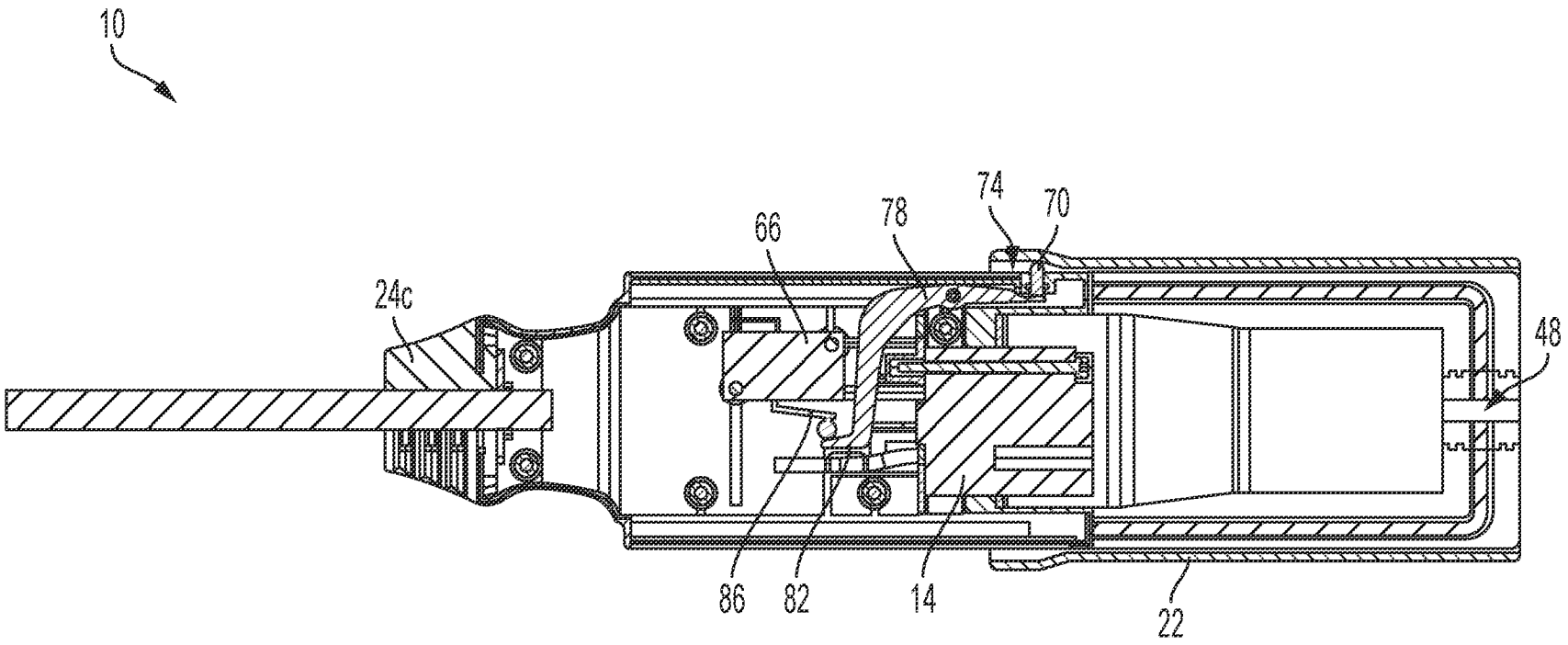
FIG. 4B is a cross-sectional side view of the electrical connector of FIG. 4A and illustrates a switch disposed within the housing and configured to be coupled to a power source.

As shown in FIGS. 4A and 4B, in the second position, grip 22 may overlie at least one biased-open housing portion (e.g., 24*a* or 24*b*) to prevent movement of the at least one biased-open housing portion (e.g., 24*a* or 24*b*) to the open position. Additionally, or alternatively, to further maintain housing 24 in the closed position, in some embodiments, a portion of housing 24 may define a structure configured to engage and/or interact with a corresponding structure of grip 22 when housing 24 is in the closed position. For example, housing 24 can define one or more detents that receive one or more protrusions defined by grip 22. To illustrate, in the embodiment shown in in FIG. 1H, housing 24 may define a detent 60 configured to receive a protrusion 64 defined by grip 22. Upon receipt by housing detent 60 of grip protrusion 64, grip 22 may be retained in the second position, thereby maintaining housing 24 in the closed position. Detent 60 and protrusion 64 may also restrict translation of grip 22 relative to housing 24, which might otherwise cause inadvertent separation of the grip and the housing.

In some embodiments, electrical connector 10 further includes a switch 66 that is disposed within housing 24 and configured to be coupled to a power source and receptacle 14. For example, in the embodiment shown in FIG. 4B, housing 24 includes switch 66 disposed within housing 24. In some such embodiments, when grip 22 is in the first position, corresponding to the open position for housing 24, switch 66 is configured to prevent electrical communication between receptacle 14 and the power source. Conversely, when grip 22 is in the second position, corresponding to the closed position for housing 24, switch 66 is configured to permit electrical communication between receptacle 14 and the power source.

Housing 24 may be moved in a first direction from a first position to a second position in which housing 24 is at the open position, and a transition from the first position to the second position may trigger switch 66 to cause receptacle 14 to be electrically decoupled from the power source when housing 24 is at the open position. Alternatively, housing 24 may be moved in a second direction from a second position to a first position in which housing 24 is at the closed position, and a transition from the second position to the first position may actuate switch 66 to cause receptacle 14 to be electrically coupled to the power source when housing 24 is at the closed position.

For example, a power source may be electrically decoupled from receptacle 14 because moving housing to the second, open position may disrupt an electrical circuit of electrical conductors coupled to switch 66. Disruption of an electrical circuit of electrical conductors coupled to switch 66 may be facilitated by engagement and/or interaction of a switch mechanism within housing 24 with a corresponding structure defined by grip 22 such that by sliding grip 22 in a first direction to a first position to transition housing 24 to the second, open position deactivates switch 66. The switch mechanism can include a plunger 70 that extends through housing 24 to engage and/or interact with a recess 74 defined by grip 22. Recess 74 defined by grip 22 may define a ramp. Plunger 70 may be coupled to a pivotable first lever 78 having an arm 82, and arm 82 of pivotable first lever may in turn be coupled to a pivotable second lever 86. Pivotable second lever 86 may be coupled to switch 66. Sliding grip 22 in a first direction to a first position to transition housing 24 to the second, open position may cause plunger 70 to be depressed as grip 22 moves in the first direction and forces plunger 70 down along the ramp defined by recess 74 until plunger 70 is fully depressed by grip 22 at the bottom of the ramp defined by recess 74. Depression of plunger 70 can cause first lever 78 to pivot upward, and pivoting of first lever 78 upward can raise first lever arm 82, which can cause pivoting of second lever 86 toward switch 66. Pivoting of second lever 86 toward switch 66 may trip an electrical circuit within switch 66, thereby electrically decoupling the power source from receptacle 14. Such a configuration can provide enhanced safety given that current need not flow through the plug when it is initially inserted into receptacle 14. Instead, such flow can occur after the plug and receptacle are moved to a (e.g., more remote, relative to the user) location and the housing is transitioned to the closed position.

A power source may also be electrically coupled to receptacle 14 because moving housing to the first, closed position may complete an electrical circuit of electrical conductors coupled to switch 66. Completion of an electrical circuit of electrical conductors coupled to switch 66 may be facilitated by engagement and/or interaction of a switch mechanism within housing 24 with a corresponding structure defined by grip 22 such that by sliding grip 22 in a second direction to a second position to transition housing 24 to the first, closed position activates switch 66. Sliding grip 22 in a second direction to a second position to transition housing 24 to the first, closed position may cause plunger 70 to rise as grip 22 moves in the second direction and plunger 70 moves along the ramp defined by recess 74 until plunger 70 is fully extended at the top of the ramp defined by recess 74. Rising of plunger 70 can cause first lever 78 to pivot downward, and pivoting of first lever 78 downward can lower first lever arm 82, which can cause pivoting of second lever 86 away from switch 66. Pivoting of second lever 86 away from switch 66 may actuate switch 66, thereby electrically coupling the power source to receptacle 14.

FIG. 1A illustrates electrical connector 10 with housing 24 in the second, open position. In FIG. 1A, plug 140 may be coupled to receptacle 14. Additionally, housing 24 is in an open configuration, such that plug 140 and a portion of cord may be received within housing 24. Once housing 24 is transitioned to the first, closed position, as shown in FIG. 4B, plug 140 may be protected from weather conditions such as precipitation (e.g., rain, snow, etc.) or other moisture. Additionally, to prevent a ground fault, and thus injury to a person, plug 140 may not be coupled (via receptacle 14) to a power source until housing 24 is moved in the first direction to transition housing from the second, open position to the first, closed position and switch 66 is actuated. Transitioning housing 24 from the second, open position to the first, closed position may cause receptacle 14 to be electrically coupled a power source when housing 24 is at the first, closed position, as described above. Because plug 140 is coupled to receptacle 14, plug 140 is thus coupled to switch 66, and if switch 66 is coupled to a power source, current may flow from switch 66, through receptacle 14 and plug 140, and to a cord of plug 140.

Thus, FIGS. 1A-1H describe electrical connector 10 with one or more integrated and/or unitary components to ensure the connector 10 forms a secure seal around receptacle 14 and/or plug 140. For example, multi-polymeric housing 24 and housing portions 24*a* and 24*b* thereof can operate to form an enclosed chamber that protects receptacle 14 and/or plug 140 from precipitation, such as rain or snow, or other moisture. Additionally, in some embodiments, because housing 24 is in the second, open position when plug 140 is coupled to receptacle 14, receptacle 14 is not coupled to a power source when plug 140 is inserted into receptacle 14. Instead, receptacle 14 is coupled to the power source when housing 24 is at the first, closed position (e.g., after insertion of plug 140 in receptacle 14 and transition of housing 24 from second, open position to first, closed position) and switch 66 is actuated. Thus, a danger of electrical shock to a user is reduced or prevented.

Methods of making an electrical connection may be performed by any electrical connector disclosed herein. Some methods of making an electrical connection include inserting a plug 140 of a power cord through at least two housing portions 24*a* and 24*b* of a housing 24 while the housing portions 24*a* and 24*b* are in an open position to which at least one of the housing portions 24*a* or 24*b* is biased and into a receptacle 14 that is disposed within the housing 24. Then, housing portions 24*a* and 24*b* are moved and relative to one another to a closed position. Movement of housing portions 24*a* and 24*b* to the closed position may be enabled by moving a grip 22 that is coupled to the housing 24 relative to the housing 24 from a first position to a second position in which the grip 22 overlies more of the at least one biased-open housing portion 24*a* or 24*b* than when the grip 22 is in the first position. In some embodiments, when the housing portions are in the closed position, the housing portions contact a portion of the power cord that extends to the plug.

In some methods, the housing portions 24*a* and 24*b* are not hinged. Additionally, or alternatively, in some methods, the at least one biased-open housing portion 24*a* or 24*b* comprises a first resilient polymer 28. Optionally, the first resilient polymer 28 comprises polyetherimide. In some such methods, the at least one biased-open housing portion 24*a* or 24*b* includes a frame that is defined by the first resilient polymer 28 and a second resilient polymer 32. In some methods, the second resilient polymer 32 is coupled to the frame such that, when the housing portions 24*a* and 24*b* are in the closed position, the second resilient polymer 32 contacts at least one other of the housing portions; and the second resilient polymer 32 has a stiffness that is 50% or less of a stiffness of the first resilient polymer 28. Optionally, the second resilient polymer comprises silicone.

In some methods, at least one of the housing portions 24*a* or 24*b* defines a rib 40 that receives a groove 44 of another one of the housing portions 24*a* or 24*b* when the housing portions are in the closed position. In some such methods, the outer surface at least one of the rib 40 and the groove 44 is defined by the second resilient polymer 32. In some methods, when the housing portions 24*a* and 24*b* are in the closed position, the housing portions define a passageway 48 that receives the portion of the power cord contacted by the housing portions, and a minimum transverse dimension of the passageway 48 decreases along the passageway. In some such methods, at least a portion of the passageway 48 is defined by the second resilient polymer 32.

In some methods, the electrical connector further includes a detent 60 configured to maintain the grip 22 in the second position. Additionally, or alternatively, in some methods, the grip 22 defines a channel 52, and the housing 24 defines a ridge 56 that is received by the channel 52 such that the ridge and the channel guide the grip 22 between the first position and the second position. In some such methods, a portion of the ridge 56 that contacts the channel 52 is defined by the frame of the at least one biased-open housing portion 24*a* or 24*b*.

In some methods, the electrical connector 10 further includes a switch 66 that is disposed within the housing 24 and configured to be coupled to a power source. In some such embodiments, when the grip 22 is in the first position, the switch prevents electrical communication between the receptacle 14 and the power source. In some such embodiments, moving the grip 22 to the second position actuates switch 66 to permit electrical communication between the receptacle 14 and the power source, as described above.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this disclosure. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiments. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments. Accordingly, no single embodiment described herein should be construed as limiting and embodiments of the disclosure may be suitably combined without departing from the teachings of the disclosure.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An electrical connector comprising:
a receptacle;
a housing within which the receptacle is disposed, the housing including:
an openable first end having at least two housing portions that are movable relative to each other between:
an open position in which the receptacle is accessible by a plug through the housing portions; and
a closed position in which the receptacle is not accessible by the plug through the housing portions;
wherein at least one of the housing portions is biased toward the open position; and
a second end; and
a grip coupled to the housing such that the grip is movable relative to the housing between:
a first position in which the grip permits movement of the housing portions to the open position; and
a second position in which the grip overlies the at least one biased-open housing portion such that the grip prevents movement of the housing portions to the open position.

2. The electrical connector of claim 1, wherein the housing portions are not hinged.

3. The electrical connector of claim 1, comprising a detent configured to maintain the grip in the second position.

4. The electrical connector of claim 1, wherein:
the electrical connector includes a switch that is disposed within the housing and configured to be coupled to a power source;
when the grip is in the first position, the switch prevents electrical communication between the receptacle and the power source; and
when the grip is in the second position, the switch permits electrical communication between the receptacle and the power source.

5. The electrical connector of claim 1, wherein the at least one biased-open housing portion comprises a first resilient polymer.

6. The electrical connector of claim 5, wherein the first resilient polymer comprises polyetherimide.

7. The electrical connector of claim 5, wherein:
the at least one biased-open housing portion comprises:
a frame that is defined by the first resilient polymer; and
a second resilient polymer that is coupled to the frame such that, when the housing portions are in the closed position, the second resilient polymer contacts at least one other of the housing portions; and
the second resilient polymer has:
a stiffness that is 50% or less of a stiffness of the first resilient polymer; and
a hardness of between 30 and 90 Shore A.

8. The electrical connector of claim 7, wherein the second resilient polymer comprises silicone.

9. The electrical connector of claim 1, wherein:
the grip defines a channel;
the housing defines a ridge that is received by the channel; and
the ridge and the channel are configured to guide the grip between the first position and the second position.

10. The electrical connector of claim 9, wherein:
the at least one biased-open housing portion comprises:
a first resilient polymer; and
a frame that is defined by the first resilient polymer; and wherein a portion of the ridge that contacts the channel is defined by the frame of the at least one biased-open housing portion.

11. The electrical connector of claim 1, wherein at least one of the housing portions defines a rib that is configured to be received by a groove of another one of the housing portions when the housing portions are in the closed position.

12. The electrical connector of claim 11, wherein:

the at least one biased-open housing portion comprises:

a first resilient polymer;

a frame that is defined by the first resilient polymer; and a second resilient polymer that is coupled to the frame; and wherein the outer surface at least one of the rib and the groove is defined by the second resilient polymer.

13. The electrical connector of claim 1, wherein:

when the housing portions are in the closed position, the housing portions define a passageway configured to receive a power cord; and a minimum transverse dimension of the passageway decreases along the passageway.

14. The electrical connector of claim 13, wherein:

the at least one biased-open housing portion comprises:

a first resilient polymer;

a frame that is defined by the first resilient polymer; and a second resilient polymer that is coupled to the frame; and wherein at least a portion of the passageway is defined by the second resilient polymer.

15. A method for making an electrical connection, the method comprising:

inserting a plug of a power cord:

through at least two housing portions of a housing while the housing portions are in an open position to which at least one of the housing portions is biased; and into a receptacle that is disposed within the housing; and moving the housing portions relative to one another to a closed position at least by moving a grip that is coupled to the housing relative to the housing from a first position to a second position in which the grip overlies more of the at least one biased-open housing portion than when the grip is in the first position;

wherein, when the housing portions are in the closed position, the housing portions contact a portion of the power cord that extends to the plug.

* * * * *